US010947670B2

(12) United States Patent
Räsänen

(10) Patent No.: US 10,947,670 B2
(45) Date of Patent: Mar. 16, 2021

(54) DRYING/TRANSPORTATION AND RELEASING MFC

(71) Applicant: STORA ENSO OYJ, Helsinki (FI)

(72) Inventor: Jari Räsänen, Imatra (FI)

(73) Assignee: Stora Enso OYJ, Helsinki (FI)

( * ) Notice: Subject to any disclaimer, the term of this patent is extended or adjusted under 35 U.S.C. 154(b) by 104 days.

(21) Appl. No.: 16/091,156

(22) PCT Filed: Apr. 7, 2017

(86) PCT No.: PCT/IB2017/052008

§ 371 (c)(1),
(2) Date: Oct. 4, 2018

(87) PCT Pub. No.: WO2017/178938

PCT Pub. Date: Oct. 19, 2017

(65) Prior Publication Data

US 2019/0127911 A1 May 2, 2019

(30) Foreign Application Priority Data

Apr. 11, 2016 (SE) ..... 1650486-2

(51) Int. Cl.

| | |
|---|---|
| ***D21H 17/67*** | (2006.01) |
| ***D21H 11/18*** | (2006.01) |
| ***D21C 9/00*** | (2006.01) |
| ***D21H 17/25*** | (2006.01) |
| ***D21H 17/65*** | (2006.01) |
| ***D21C 3/04*** | (2006.01) |
| ***D21C 3/06*** | (2006.01) |
| ***D21C 3/16*** | (2006.01) |
| ***D21C 9/08*** | (2006.01) |

(52) U.S. Cl.

CPC ..... *D21H 17/67* (2013.01); *D21C 3/04* (2013.01); *D21C 3/06* (2013.01); *D21C 3/16* (2013.01); *D21C 9/007* (2013.01); *D21C 9/083* (2013.01); *D21C 9/086* (2013.01); *D21H 11/18* (2013.01); *D21H 17/25* (2013.01); *D21H 17/65* (2013.01)

(58) Field of Classification Search

CPC ..... D21H 17/67

See application file for complete search history.

(56) References Cited

U.S. PATENT DOCUMENTS

| | | | |
|---|---|---|---|
| 4,481,076 | A | 11/1984 | Herrick |
| 5,437,908 | A | 8/1995 | Demura et al. |
| 5,731,080 | A | 3/1998 | Cousins et al. |
| 2015/0045549 | A1 | 2/2015 | Laukkanen et al. |
| 2015/0299959 | A1 | 10/2015 | Axrup et al. |

FOREIGN PATENT DOCUMENTS

| | | | |
|---|---|---|---|
| CN | 104136681 | A | 11/2014 |
| CN | 104903512 | A | 9/2015 |
| EP | 0846703 | A1 | 6/1998 |
| WO | 9844181 | A1 | 10/1998 |
| WO | 2014072913 | A1 | 5/2014 |

OTHER PUBLICATIONS

Smook, Handbook for Pulp and Paper Technologists, 1992, Angus Wilde Publications, 2nd edition, chapters 13 and 15. (Year: 1992).*

International Search Report for PCT/IB2017/052008, dated Jun. 14, 2017.

* cited by examiner

*Primary Examiner* — Anthony Calandra

(74) *Attorney, Agent, or Firm* — Greer, Burns & Crain, Ltd.

(57) ABSTRACT

A method of forming an aqueous solution comprising mircrofibrillated cellulose, the method comprising the steps of providing a substantially dry composite material, comprising microfibrillated cellulose and a filler material, wherein said filler material is precipitated onto fibers or fibrils of said microfibrillated cellulose; providing an aqueous media, wherein the method further comprises the step of lowering the pH value of said aqueous media and then mixing said aqueous media with said substantially dry composite material, such that the filler material is released from said microfibrillated cellulose, thus dissolving said microfibrillated cellulose; or the step of mixing said aqueous media with said substantially dry composite material, and then lowering the pH of said mixture, such that the filler material is released from said microfibrillated cellulose, thus releasing said microfibrillated cellulose.

12 Claims, No Drawings

DRYING/TRANSPORTATION AND RELEASING MFC

This application is a U.S. National Phase under 35 U.S.C. § 371 of International Application No. PCT/IB2017/052008, filed Apr. 7, 2017, which claims priority under 35 U.S.C. §§ 119 and 365 to Swedish Application No. 1650486-2, filed Apr. 11, 2016.

TECHNICAL FIELD

The present document relates to method of dissolving a composite comprising microfibrillated cellulose and a filler, such that the microfibrillated cellulose is released into an aqueous solution.

BACKGROUND

When microfibrillated or nanofibrillated cellulose (MFC/NFC), also called cellulose microfibrils (CMF), is produced and dissolved in water, the aqueous fiber suspension usually does not include more than 1% of fiber and the rest is water. This very low fiber concentration involves high transportation costs for MFC/NFC in practice, since pumping and transportation load includes mainly water and minor share of fibers. This is of course a limiting factor for using MFC/NFC outside of the sites where MFC/NFC is produced.

Applications of MFC/NFC may be for instance in the fields of food, cosmetics, paints, plastics, paper, medical products and composites and the MFC/NFC thus needs to be transported to these types of production facilities.

It is possible to dry the MFC/NFC in order to achieve a semi-solid or solid material which can transported in a more cost efficient manner. However, for applications requiring that the MFC/NFC is dissolved or released in an aqueous solution, these types of dried MFC/NFC might not be useable as they can be difficult to dissolve or release once they have been dried. Some of the conventional drying techniques used are further quite expensive, such as freeze drying and spray drying.

When spray drying MFC/NFC the problem of hornification also often arises and this has conventionally been solved by adding different types of chemicals, such as surface active agent. Some of these chemicals are however not desirable from an environmental point of view, and some chemicals cannot be used in food or medical products, and in addition to this the cost of these chemicals can also be quite high.

In WO2014072913 an effective new method of drying a composite material comprising MFC is disclosed, where particles of a filler, such as precipitated calcium carbonate are allowed to form on the surface of the fibers or fibrils, and where a dry composite is subsequent formed by a drying and mixing operation. The MFC fibers thus forms a core which is covered by PCC particles. This creates a composite material comprising MFC that can be stored, transported and then used in a dry state and be readily dispersed (as a composite). The MFC/PCC-composite may then be used in for instance plastics or paper/paperboard production.

There is thus a need for a method where MFC/NFC can be more cost efficiently transported, preferably in a substantially dry state, and then can be converted back into a dissolved or released state for subsequent use in different applications.

SUMMARY

It is an object of the present disclosure, to provide an improved method for transporting microfibrillated cellulose in a dry or substantially state and then dissolving it into an aqueous solution.

The object is wholly or partially achieved a method according to the appended independent claims. Embodiments are set forth in the appended dependent claims, and in the following description and drawings.

According to a first aspect, there is provided a method of forming an aqueous solution comprising microfibrillated cellulose, the method comprising the steps of providing a substantially dry composite material, comprising microfibrillated cellulose and a filler material, wherein said filler material is precipitated onto fibers or fibrils of said microfibrillated cellulose; and providing an aqueous media, wherein the method further comprises the step of:

lowering the pH value of said aqueous media and then mixing said aqueous media with said substantially dry composite material, such that the filler material is released from said microfibrillated cellulose, thus dissolving said microfibrillated cellulose;

or the step of mixing said aqueous media with said substantially dry composite material, and then lowering the pH of said mixture, such that the filler material is released from said microfibrillated cellulose, thus releasing said microfibrillated cellulose.

Through this method there is provided a way of forming an aqueous solution comprising released or separated microfibrillated cellulose (MFC), by using a dried form of the MFC. The MFC may thus have been transported or stored in the dry composite form and then added to a process where they are needed.

The composite may have been formed as disclosed in WO2014072913. It is thus possible to transport and dose MFC to a process in an efficient way. Microfibrillated cellulose may for instance be used for providing strength and bulk properties to paper or paperboard.

The pH of the aqueous media may be lowered prior to the addition of the composite material, or it may be lowered after the addition.

This means that the dry composite material may thus be added or mixed into for instance the stock solution and that an acidic agent is added subsequently.

The filler material may be a precipitated filler material being any one of a precipitated calcium carbonate and a precipitated magnesium carbonate, or a mixture thereof, and said precipitated filler material may be formed or precipitated onto the fibers of the microfibrillated cellulose by allowing precursors of said precipitated filler to react with each other in the presence of said microfibrillated cellulose.

The aqueous media may be a process media in a paper making process.

The process media may be any one of a pulp and a stock solution.

This means that the microfibrillated cellulose can be released directly into the stock or pulp and be dosed in the process media depending on the desired application.

In the method according to the first aspect, an acidic agent may be used in the step of lowering the pH of the aqueous media.

The acidic agent may be any one of alum, hydrochloric acid, sulfuric acid, citric acid, phosphoric acid, acetic acid and nitric acid.

The pH may be lowered to a value sufficiently low for the precipitated filler to decompose.

By "sufficiently low" is meant that the pH is lowered or adjusted to a level where an efficient decomposition of the precipitated filler can take place.

The acidic agent may for instance have to be added in an amount sufficient to reduce or break down the buffering effect of the decomposing composite.

The step of mixing said aqueous media with said substantially dry composite material may be performed under stirring.

By stirring the mixture a more efficient decomposition of the precipitated filler material, and also a more even pH distribution in the aqueous solution, may be achieved.

In one alternative the dry composite material is added to the aqueous media at the same time as the pH is lowered. This means that the dry composite and the acidic agent may be added simultaneously.

The concentration of microfibrillated cellulose in the aqueous solution may be in the range of 0.1 to 20% based on the total dry content of the aqueous solution. That means that after lowering the pH in the aqueous solution, the concentration of the released microfibrillated may be in this range. The concentration can be calculated based on the addition of the composite.

The substantially dry composite material may be added in the form of any one of a powder and a particulate material or a mixture thereof. This means that the composite material may be easily transported to the facility or process where it is to be used, and that the microfibrillated cellulose may thereafter be easily dosed into the process and released by the acidic addition in for instance the process water such as the stock solution. The powdered composite may thus be dosed into the stock solution and the pH lowered by addition of an acid, thereby releasing the microfibrillated cellulose into the stock solution.

DESCRIPTION OF EMBODIMENTS

In the present disclosure a process for transporting and dosing microfibrillated cellulose (MFC) in an efficient manner is disclosed. The MFC is transported and dosed as a dry composite material.

Microfibrillated cellulose (MFC) shall in the context of the patent application mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods. The smallest fibril is called elementary fibril and has a diameter of approximately 2-4 nm (see e.g. Chinga-Carrasco, G., *Cellulose fibres, nanofibrils and microfibrils: The morphological sequence of MFC components from a plant physiology and fibre technology point of view, Nanoscale research letters* 2011, 6:417), while it is common that the aggregated form of the elementary fibrils, also defined as microfibril (Fengel, D., *Ultrastructural behavior of cell wall polysaccharides, Tappi J.*, March 1970, Vol 53, No. 3.), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregates and cellulose microfibril aggregates. MFC can also be characterized by various physical or physical-chemical properties such as large surface area or its ability to form a gel-like material at low solids (1-5 wt %) when dispersed in water. The cellulose fiber is preferably fibrillated to such an extent that the final specific surface area of the formed MFC is from about 1 to about 200 m2/g, or more preferably 50-200 m2/g when determined for a freeze-dried material with the BET method.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CMC), aldehyde and/or carboxyl groups (cellulose obtained by N-oxyl mediated oxydation, for example "TEMPO"), or quaternary ammonium (cationic cellulose). After being modified or oxidized in one of the above-described methods, it is easier to disintegrate the fibers into MFC or nanofibrillar size or NFC.

The nanofibrillar cellulose may contain some hemicelluloses; the amount is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated.

MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The above described definition of MFC includes, but is not limited to, the new proposed TAPPI standard W13021 on cellulose nanofibril or microfibril (CMF) defining a cellulose nanofibre material containing multiple elementary fibrils with both crystalline and amorphous regions, having a high aspect ratio with width of 5-30 nm and aspect ratio usually greater than 50.

The composite material comprising a filler material and microfibrillated cellulose may be achieved through the method as disclosed in WO2014072913.

In this process a filler material is allowed to react or precipitate in an aqueous solution in which microfibrillated cellulose is present, such that the precipitation takes place on the surface of the fibers and fibrils of the microfibrillated cellulose. This suspension is then dried in a simultaneous mixing and heating operation, providing the composite with specific characteristics.

The composite material may be formed by providing a suspension of MFC in an aqueous solution, and adding carbon dioxide to this suspension such that calcium carbonate precipitates (PCC) onto the fibers or fibrils of the MFC.

In this method stone-like particles of the dry composite material can be formed, which may then be easily transported to any process site where it is needed and dosed into the process accordingly. In WO2014072913 different usages for the composite material is disclosed, where the composite can be dispersed into different applications.

There are also other methods for forming composite materials or dry composites comprising microfibrillated cellulose known in the art, and these composites may also be used in the present method for releasing MFC into a process media from the composite complex by using an acidic media.

In the below a method of dissolving the composite as formed according to WO2014072913 is described, where the MFC is released into a process liquid, thus providing a way of transporting and dosing the MFC itself in a more convenient manner, than compared to transporting MFC in water solution. This method could be equivalently used for other composites comprising MFC, where the MFC can be released from the composite complex by lowering the pH value with e.g. an acidic media.

The composite material is preferably dosed in an aqueous solution, or a solution comprising fibrous material, such as a process liquid in a paper making process. The composite material may be added in the form of any one of a powder and a particulate material or a mixture thereof.

The process liquid may for instance be a pulp or stock solution, into which MFC is to be dosed.

The composite material may for instance be added in the mixing chest, barrel, tower or container, or anywhere in a process where MFC is needed.

The pH value of the process liquid is then lowered, preferably by using of an acidic media or agent, so that the PCC particles on the surfaces of the MFC fibers or fibrils are released, and carbon dioxide generated and separated. When the carbon dioxide is separated the MFC fibers can be released in the process site.

The pH value is lowered or adjusted to a level where an efficient decomposition of the precipitated filler can take place. This means that the amount of acidic agent that is added will be dependent and adjusted according to the desired decomposition rate and to the current pH in the aqueous media. The ph value in the aqueous media may for instance be continuously measured, and the addition of acidic media may thus be automatically controlled and administered accordingly.

The pH value of the process liquid may alternatively be lowered during stirring of the process liquid. The stirring may be achieved for instance by a motorized mixing device, such as a fan or rotor.

The acidic media or agent may be for instance alum, which is conventionally used in stock preparation. Alternatively the acidic media or agent may be any other suitable acid such a hydrochloric acid (HCl), sulphuric acid ($H_2SO_4$), acetic acid or nitric acid.

In one example, the composite is added to the stock preparation, comprising a motorized mixing device. The pH is lowered by addition of an acid. In this way, the precipitated calcium carbonate, PCC ($CaCO_3$) will break-down to calcium ions (Ca) and carbon dioxide ($CO_2$) will be released. The $CO_2$ will be released into the surrounding air and taken care of by the ventilation system. Ca ions are always present in such systems and cause no problems. The lower pH value is the faster the reaction will take place.

The MFC fibers will be released in the stock/pulp.

The decomposing of PCC will buffer the pH value of the of the process liquid into the level of 8.6. The acid agent or media thus needs to be added in an amount enough to break down this buffering effect.

The MFC fibers released in the aqueous media may then be used for different types of subsequent applications where it is needed.

The concentration of the released MFC in the aqueous solution or media may for instance be in the range of 0.1 to 20% based on the total dry content of the aqueous solution, or alternatively in the range of 0.1 to 15%, or in the range of 0.1 to 10%. The concentration of MFC will be dependent on the desired application of the MFC. The amount or addition of the composite material can thus be calculated based on the known MFC content of composite, and the subsequent desired MFC content of the aqueous solution.

The invention claimed is:

1. A method of forming an aqueous solution comprising microfibrillated cellulose, the method comprising the steps of:

providing a substantially dry composite material, comprising microfibrillated cellulose and a filler material, wherein said filler material is precipitated onto fibers or fibrils of said microfibrillated cellulose;

providing an aqueous media, wherein the method further comprises the steps of:

lowering the pH value of said aqueous media to a level at which the filler material decomposes by a method consisting essentially of adding an acidic agent, wherein the acidic agent is any one of hydrochloric acid, sulfuric acid, citric acid, phosphoric acid, and nitric acid, mixing said aqueous media with said substantially dry composite material, before, at the same time as, or after the step of lowering of the pH, such that the filler material precipitated onto the fibers or fibrils of said microfibrillated cellulose decomposes and generates carbon dioxide releasing said microfibrillated cellulose.

2. The method as claimed in claim 1, wherein said filler material is a precipitated filler material being any one of a precipitated calcium carbonate and a precipitated magnesium carbonate, or a mixture thereof, and wherein said precipitated filler material is formed or precipitated onto the fibers of the microfibrillated cellulose by allowing precursors of said precipitated filler to react with each other in the presence of said microfibrillated cellulose.

3. The method as claimed in claim 1, wherein the aqueous media is a process media in a paper making process.

4. The method as claimed in claim 3, wherein said process media is any one of a pulp and a stock solution.

5. The method as claimed in claim 1, wherein the step of mixing is performed under stirring.

6. The method as claimed in claim 1, wherein the dry composite material is added to the aqueous media at the same time as the pH is lowered.

7. The method as claimed in claim 1, wherein the concentration of microfibrillated cellulose in the aqueous solution is in the range of 0.1 to 20% based on the total dry content of the aqueous solution.

8. The method as claimed in claim 1, wherein said substantially dry composite material is added in the form of any one of a powder and a particulate material or a mixture thereof.

9. The method of claim 1 wherein the acidic agent is added in an amount sufficient to break down a buffering effect caused by decomposition of the filler material.

10. The method of claim 1 further comprising:

measuring the pH and adjusting an amount of the acidic agent added.

11. The method of claim 1 further comprising:

providing a suspension of said microfibrillated cellulose;

reacting precursors of the filler material in the presence of said microfibrillated cellulose and precipitating the filler material onto the fibers or fibrils of said microfibrillated cellulose;

drying the suspension to form the substantially dry composite material.

12. The method of claim 1 further comprising:

adding carbon dioxide to a suspension of microbrillated cellulose in an aqueous solution of precursors of the filler material and precipitating the filler material onto the fibers or fibrils of said microfibrillated cellulose;

drying the suspension to form the substantially dry composite material.

* * * * *